US008460610B2

(12) United States Patent
Silver et al.

(10) Patent No.: US 8,460,610 B2
(45) Date of Patent: Jun. 11, 2013

(54) CANISTER AFTERTREATMENT MODULE

(75) Inventors: Ronald G. Silver, Peoria, IL (US); Craig P. Hittle, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 654 days.

(21) Appl. No.: 12/644,936

(22) Filed: Dec. 22, 2009

(65) Prior Publication Data

US 2011/0146252 A1 Jun. 23, 2011

(51) Int. Cl.
*B01D 50/00* (2006.01)

(52) U.S. Cl.
USPC ..... 422/171; 422/177

(58) Field of Classification Search
USPC ..... 422/176, 177, 180
See application file for complete search history.

(56) References Cited

U.S. PATENT DOCUMENTS

| | | | | |
|---|---|---|---|---|
| 5,043,146 | A * | 8/1991 | Ishikawa et al. | 422/176 |
| 5,325,666 | A | 7/1994 | Rutschmann | |
| 5,604,980 | A | 2/1997 | Shustorovich et al. | |
| 6,449,947 | B1 | 9/2002 | Liu et al. | |
| 6,557,341 | B2 | 5/2003 | Bubeck et al. | |
| 6,620,391 | B2 | 9/2003 | Müller et al. | |
| 6,680,037 | B1 | 1/2004 | Allansson et al. | |
| 6,713,025 | B1 * | 3/2004 | Ivanescu et al. | 422/177 |
| 6,722,124 | B2 | 4/2004 | Pawson et al. | |
| 6,729,127 | B2 | 5/2004 | Woerner et al. | |
| 7,282,185 | B2 | 10/2007 | Harris | |
| 7,293,408 | B2 | 11/2007 | Kohler et al. | |
| 7,328,574 | B2 | 2/2008 | Vignassa et al. | |
| 2003/0070424 | A1 | 4/2003 | Verdegan et al. | |
| 2005/0252201 | A1 | 11/2005 | Lecea et al. | |
| 2006/0153748 | A1 | 7/2006 | Huthwohl et al. | |
| 2006/0153761 | A1 | 7/2006 | Bandl-Konrad et al. | |
| 2006/0156712 | A1 | 7/2006 | Buhmann et al. | |
| 2007/0012035 | A1 * | 1/2007 | Amemiya et al. | 60/299 |
| 2007/0137184 | A1 * | 6/2007 | Patchett et al. | 60/286 |
| 2007/0289294 | A1 | 12/2007 | Werni et al. | |
| 2008/0093163 | A1 | 4/2008 | Frederiksen | |
| 2008/0264048 | A1 | 10/2008 | Nishiyama et al. | |
| 2008/0314033 | A1 | 12/2008 | Aneja et al. | |

(Continued)

FOREIGN PATENT DOCUMENTS

| | | |
|---|---|---|
| EP | 1 510 674 | 3/2005 |
| JP | 09-088569 | 3/1997 |

(Continued)

OTHER PUBLICATIONS

Harold Holmes (California EPA), "California's Locomotive Emission Reduction Needs", CARB Locomotive Symposium, Nov. 28, 2007, pp. 1-14.

(Continued)

*Primary Examiner* — Tom Duong
(74) *Attorney, Agent, or Firm* — Finnegan, Henderson, Farabow, Garrett & Dunner LLP

(57) ABSTRACT

An aftertreatment module for use with an engine is disclosed. The aftertreatment module may have a canister, and a wall disposed within the canister and axially-dividing the canister into a first portion and a second portion. The aftertreatment module may also have a first treatment device disposed within the first portion, an inlet connected to the first portion, a second treatment device disposed within the second portion, an outlet connected to the second portion, and an external tube extending from the first portion to the second portion.

20 Claims, 2 Drawing Sheets

U.S. PATENT DOCUMENTS

| | | | | |
|---|---|---|---|---|
| 2009/0007551 | A1 | 1/2009 | Wahlstrom et al. | |
| 2009/0158720 | A1 | 6/2009 | Krause et al. | |
| 2010/0206060 | A1 * | 8/2010 | Liu et al. | 73/114.61 |

FOREIGN PATENT DOCUMENTS

| | | |
|---|---|---|
| JP | 2008-254572 | 10/2008 |
| JP | 2008-274850 | 11/2008 |
| JP | 2008-274851 | 11/2008 |
| JP | 2009-133228 | 6/2009 |
| WO | 0214657 | 2/2002 |
| WO | WO 02/33234 | 4/2002 |

OTHER PUBLICATIONS http://www.businesswire.com/news/google/20090209005879/e, "Detroit Diesel Previews its Blue Tec SCR Technology at TMC," Feb. 9, 2009, pp. 1-3.

Mobiclean (Hug Engineering), "Soot Particle Filter Systems for mobile diesel engines," pp. 1-4.

Motive Power (A Wabtec Company), "DOC Module", p. 6.

Mike Bogdanoff (South Coast Air Quality Management District), "Three Locomotive Demonstration Projects", CARB Locomotive Symposium, Nov. 28, 2007, pp. 1-15.

Mike Iden, (Union Pacific Railroad Company), "From idea to market: technological successes & limitations", CARB Locomotive Symposium, Nov. 28, 2007, pp. 1-11.

Steve Fritz (Southwest Research Institute), "U.S. Locomotive Aftertreatment Retrofit Progress Report: SwRI test Programs," CARB Locomotive Symposium, Nov. 28, 2007, pp. 1-96.

Union Pacific Railroad Company and BNSF Railway, "Diesel Particulate Filter (DPF) Technology for Locomotives in the US and Europe," Dec. 7, 2006, pp. 1-17.

* cited by examiner

CANISTER AFTERTREATMENT MODULE

TECHNICAL FIELD

The present disclosure is directed to an aftertreatment module and, more particularly, to a canister-type aftertreatment module.

BACKGROUND

Internal combustion engines, including diesel engines, gasoline engines, gaseous fuel-powered engines, and other engines known in the art exhaust a complex mixture of air pollutants. These air pollutants are composed of gaseous compounds including, among other things, the oxides of nitrogen ($NO_X$). Due to increased awareness of the environment, exhaust emission standards have become more stringent, and the amount of $NO_X$ emitted to the atmosphere by an engine may be regulated depending on the type of engine, size of engine, and/or class of engine.

In order to comply with the regulation of $NO_X$, some engine manufacturers have implemented a strategy called selective catalytic reduction (SCR). SCR is a process where a reductant, most commonly urea ($(NH_2)_2CO$) or a water/urea solution, is selectively injected into the exhaust gas stream of an engine and absorbed onto a downstream substrate. The injected urea solution decomposes into ammonia ($NH_3$), which reacts with $NO_X$ in the exhaust gas to form water ($H_2O$) and diatomic nitrogen ($N_2$).

In some applications, the substrate used for SCR purposes may need to be very large to help ensure it has enough surface area or effective volume to absorb appropriate amounts of the ammonia required for sufficient reduction of $NO_X$. These large substrates can be expensive and require significant amounts of space within the exhaust system. In addition, the substrate must be placed far enough downstream of the injection location for the urea solution to have time to decompose into the ammonia gas and to evenly distribute within the exhaust flow for the efficient reduction of $NO_X$. This spacing may further increase packaging difficulties of the exhaust system.

An exemplary SCR-equipped system for use with a combustion engine is disclosed in JP Patent Publication No. 2008/274,851 (the '851 publication) of Makoto published on Nov. 13, 2008. This system includes an exhaust gas purification device having a gas accumulation canister, a separate dispersion canister, and a mixing pipe connected between edges of the gas accumulation and gas dispersion canisters. A particulate filter and an oxidation catalyst are disposed in the gas accumulation canister, while an SCR catalyst and ammonia reduction catalyst are disposed within the gas dispersion canister. A urea injector is located in the mixing pipe, upstream of the SCR catalyst.

Although compact in size, the exhaust system of the '851 patent may still be problematic. In particular, the multiple canisters used in the '851 system may increase component cost, packaging complexity, and an overall size of the system. In addition, the single SCR catalyst may be large and drive up the cost of the system.

The aftertreatment module of the present disclosure solves one or more of the problems set forth above and/or other problems of the prior art.

SUMMARY

One aspect of the present disclosure is directed to an aftertreatment module. The aftertreatment module may include a canister, and a wall disposed within the canister and axially-dividing the canister into a first portion and a second portion. The aftertreatment module may also include a first treatment device disposed within the first portion, an inlet connected to the first portion, a second treatment device disposed within the second portion, an outlet connected to the second portion, and an external tube extending from the first portion to the second portion.

A second aspect of the present disclosure is directed to another aftertreatment module. This aftertreatment module may include a canister, a first treatment device located in the canister at a first end portion of the canister, and a second treatment device located in the canister at an opposing second end portion of the canister. The aftertreatment module may also include an inlet physically-located between the first and second treatment devices and upstream of both the first and second treatment devices, and an outlet physically-located between the first and second treatment devices and downstream of both the first and second treatment devices.

A third aspect of the present disclosure is directed to yet another aftertreatment module. This aftertreatment module may include a canister having an inlet at a first end and an outlet at a second opposing end. The aftertreatment module may also include an external tube connected to the inlet and having a serpentine shape with a total flow length multiple times a flow length of the canister. The external tube may be contained within an axial length dimension of the canister. The aftertreatment module may further include a first treatment device disposed within the external tube, and a second treatment device disposed within the canister.

DETAILED DESCRIPTION

Figure 1:
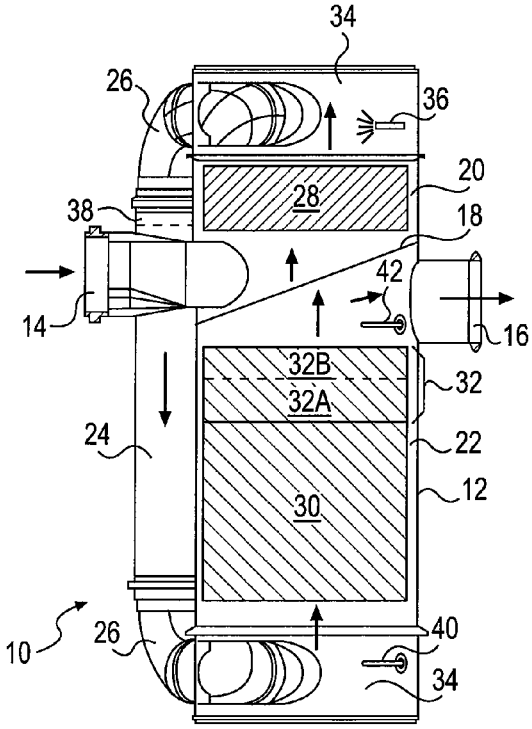
FIG. 1 is a cross-sectional illustration of an exemplary disclosed aftertreatment module.
Figure 2:
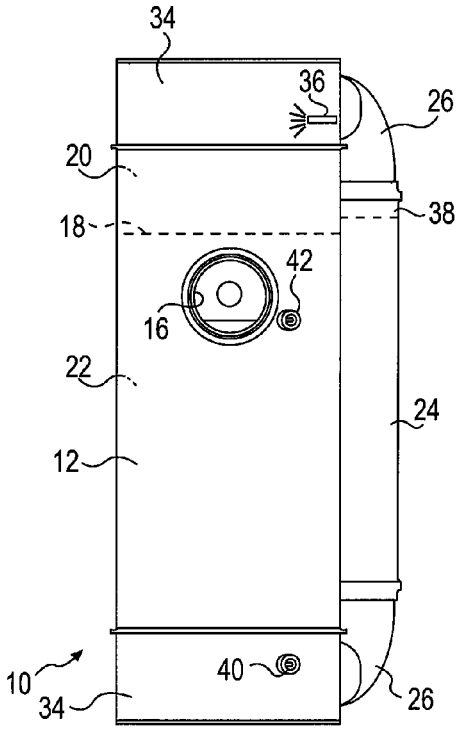
FIG. 2 is a right-side view illustration of the aftertreatment module of FIG. 1.
Figure 3:
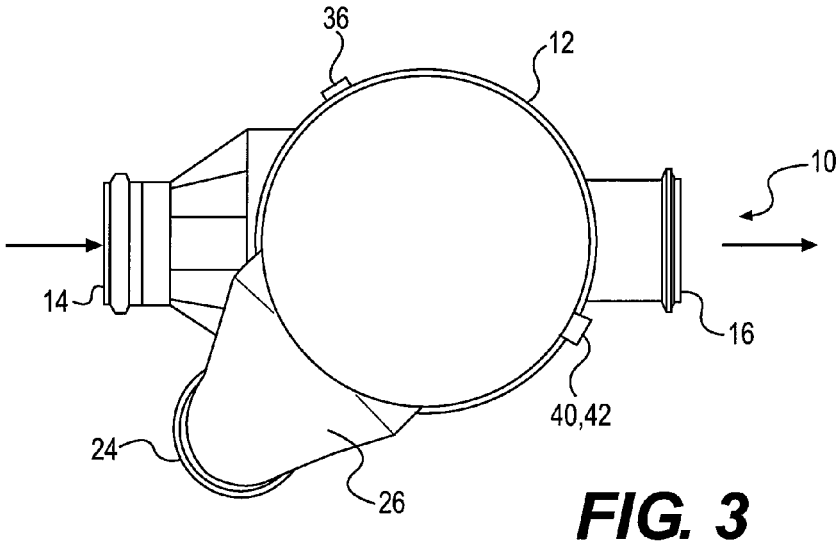
FIG. 3 is an end-view illustration of the aftertreatment module of FIG. 1.

An exemplary aftertreatment module 10 is shown in FIGS. 1-3. Aftertreatment module 10 may include a single canister 12 fabricated from a material provided with corrosion protection, for example, stainless steel. In the embodiment shown in FIGS. 1-3, canister 12 includes a single inlet 14 and a single outlet 16. It is contemplated, however, that aftertreatment 10 module may include any number of inlets and outlets, as desired. Aftertreatment module 10 may also include an internal wall 18 axially-dividing canister 12 into a first portion 20 that is hermitically sealed from a second portion 22. Wall 18 may be inclined relative to a longitudinal axis of canister 12, such that a flow area at inlet 14 and a flow area at outlet 16 becomes smaller a distance away from inlet 14 and outlet 16, respectively.

An external tube 24 may fluidly communicate first portion 20 with second portion 22. In one embodiment, external tube 24 may be axially-parallel with canister 12, and connect to a cylindrical side surface of canister 12 at opposing ends by way of flexible couplings 26. Flexible couplings 26 may embody cobra-head type couplings that are capable of bending through an angle of about 90 degrees and have an elliptical opening at canister 12 and a circular opening at tube 24. Other types of couplings may be utilized, if desired.

Aftertreatment module 10 may also include one or more treatment devices located within a first end of first portion 20, and one or more treatment devices located within a second opposing end of second portion 22. For example, an oxidation catalyst 28 may be disposed within first portion 20, while a combined diesel particulate filter/SCR (CDS) catalyst 30 may be disposed within second portion 22. In one embodiment, an additional catalyst 32 may also be located within second portion 22, downstream of CDS catalyst 30. Catalyst 32 may include an upstream region 32A that functions as an SCR catalyst, and a downstream region 32B that functions as a cleanup catalyst, for example an ammonia reduction catalyst. In an alternative embodiment, catalyst 32 may be a dedicated cleanup catalyst (e.g., catalyst 32 may not provide SCR functionality). It is contemplated that, although requiring additional space within canister 12, CDS catalyst 30 may alternatively be replaced with a separate and dedicated particulate filter and SCR catalyst, if desired. A space 34 may be maintained at the opposing ends of canister 12, axially-outward of all treatment devices disposed therein, to act as manifolds that facilitate substantially equal distribution of exhaust across faces of the respective treatment devices to and from couplings 26 of external tube 24.

In the configuration described above, inlet 14 and outlet 16 may both be located physically-between the treatment devices within first and second portions 20, 22. Inlet 14 may be located upstream of all treatment devices. Outlet 16 may be located downstream of all treatment devices. Inlet 14 may be extend from canister 12 in a direction about opposite to an extension direction of outlet 16.

Oxidation catalyst 28 may be, for example, a diesel oxidation catalyst (DOC). As a DOC, oxidation catalyst 28 may include a porous ceramic honeycomb structure, a metal mesh, a metal or ceramic foam, or another suitable substrate coated with or otherwise containing a catalyzing material, for example a precious metal, that catalyzes a chemical reaction to alter a composition of exhaust passing through oxidation catalyst 28. In one embodiment, oxidation catalyst 28 may include palladium, platinum, vanadium, or a mixture thereof that facilitates a conversion of NO to $NO_2$. In another embodiment, oxidation catalyst 28 may alternatively or additionally perform particulate trapping functions (i.e., oxidation catalyst 28 may be a catalyzed particulate trap such as a CRT or CCRT), hydro-carbon reduction functions, carbon-monoxide reduction functions, and/or other functions known in the art.

As described above, CDS catalyst 30 may be configured to perform particulate trapping functions. In particular, CDS catalyst 30 may include filtration media configured to remove particulate matter from an exhaust flow. In one embodiment, the filtration media of CDS catalyst 30 may embody a generally cylindrical deep-bed type of filtration media configured to accumulate particulate matter throughout a thickness thereof in a substantially homogenous manner. The filtration media may include a low density material having a flow entrance side and a flow exit side and be formed through a sintering process from metallic or ceramic particles. It is contemplated that the filtration media may alternatively embody a surface type of filtration media fabricated from ceramic foam, a wire mesh, or any other suitable material.

CDS catalyst 30 may also be configured to perform SCR functions. Specifically, the filtration media of CDS catalyst 30 may be fabricated from or otherwise coated with a ceramic material such as titanium oxide; a base metal oxide such as vanadium and tungsten; zeolites; and/or a precious metal. With this composition, decomposed reductant entrained within an exhaust flow passing through CDS catalyst 30 may be absorbed onto the surface and/or within of the filtration media, where the reductant may react with NOx (NO and $NO_2$) in the exhaust gas to form water ($H_2O$) and diatomic nitrogen ($N_2$). It is contemplated that CDS catalyst 30 may perform both particulate trapping and SCR functions throughout the media of CDS catalyst 30 or, alternatively, in serial stages, as desired.

As described above, catalyst 32 may comprise an upstream region 32A and a downstream region 32B. In particular, a single substrate brick of catalyst 32 may include a region (32A) located generally upstream that, similar to CDS catalyst 30, is fabricated from or otherwise coated with a material that absorbs onto a surface or otherwise internalizes reductant for reaction with NOx (NO and $NO_2$) in the exhaust gas passing therethrough to form water ($H_2O$) and diatomic nitrogen ($N_2$). At the same time, the substrate brick of catalyst 32 may include a region (32B) located generally downstream that is coated with or otherwise contains a different catalyst that oxidizes residual reductant in the exhaust.

A reductant injector 36 may be located at or near an upstream end of tube 24 (e.g., within an upstream end of tube 24, within coupling 26, or within space 34) and configured to inject a reductant into the exhaust flowing through tube 24. A gaseous or liquid reductant, most commonly a water/urea solution, ammonia gas, liquefied anhydrous ammonia, ammonium carbonate, an amine salt, or a hydrocarbon such as diesel fuel, may be sprayed or otherwise advanced by reductant injector 36 into the exhaust passing through tube 24. Reductant injector 36 may be located a distance upstream of CDS catalyst 30 to allow the injected reductant sufficient time to mix with exhaust and to sufficiently decompose before entering CDS catalyst 30. That is, an even distribution of sufficiently decomposed reductant within the exhaust passing through CDS catalyst 30 may enhance $NO_X$ reduction therein. The distance between reductant injector 36 and CDS catalyst 30 (i.e., the length of tube 24) may be based on a flow rate of exhaust passing through aftertreatment module 10 and/or on a cross-sectional area of tube 24. In the example depicted FIGS. 1-3, tube 24 may extend a majority of a length of canister 12.

To enhance incorporation of the reductant with exhaust, a mixer 38 may be located within tube 24. In one embodiment, mixer 38 may include vanes or blades inclined to generate a swirling motion of the exhaust as it flows through tube 24. In another embodiment, mixer 38 may include a ring extending from internal walls of tube 24 radially inward a distance toward a longitudinal axis of tube 24, the ring being configured to promote exhaust flow turbulence within tube 24. In either embodiment, mixer 38 may be located upstream or downstream (shown in FIGS. 1-3) of reductant injector 36.

One or more probes may be situated to monitor parameters of aftertreatment module 10. For example, a first probe 40 may be situated within space 34 of second portion 22 (e.g., axially-outward from CDS catalyst 30 relative to a center of canister 12), while a second probe 42 may be situated within second portion 22 at outlet 16 (e.g., axially-between oxidation catalyst 28 and catalysts 30 and 32). In one embodiment, first probe 40 may be a temperature probe configured to generate a first signal indicative of a temperature of the exhaust entering CDS catalyst 30. The first signal may be utilized to determine, among other things, an operating temperature and predicted efficiency of CDS catalyst 30. Second probe 42 may be utilized to detect a constituent of the exhaust exiting catalyst 32, for example a concentration of NOx or residual reductant. Second probe 42 may generate a second signal indicative of this constituent, the second signal being utilized to determine, among other things, an actual effectiveness of CDS catalyst 30 and/or catalyst 32. It is contemplated that first and/or second probes 40, 42 may be configured to monitor other parameters and be utilized for other purposes, if desired.

It is contemplated that access to the treatment devices of aftertreatment module 10 may be helpful in some situations. Thus, in one embodiment, the end-portions of canister 12 enclosing spaces 34 at each opposing end of aftertreatment module 10 may be removably connected to a center portion of canister 12 that encloses oxidation catalyst 28, CDS 30, and catalyst 32. For example, the end-portions could be bolted or latched to the center portion, if desired. With this configuration, the end-portions may be selectively removed for inspection and/or replacement of the various catalysts.

Figure 4:
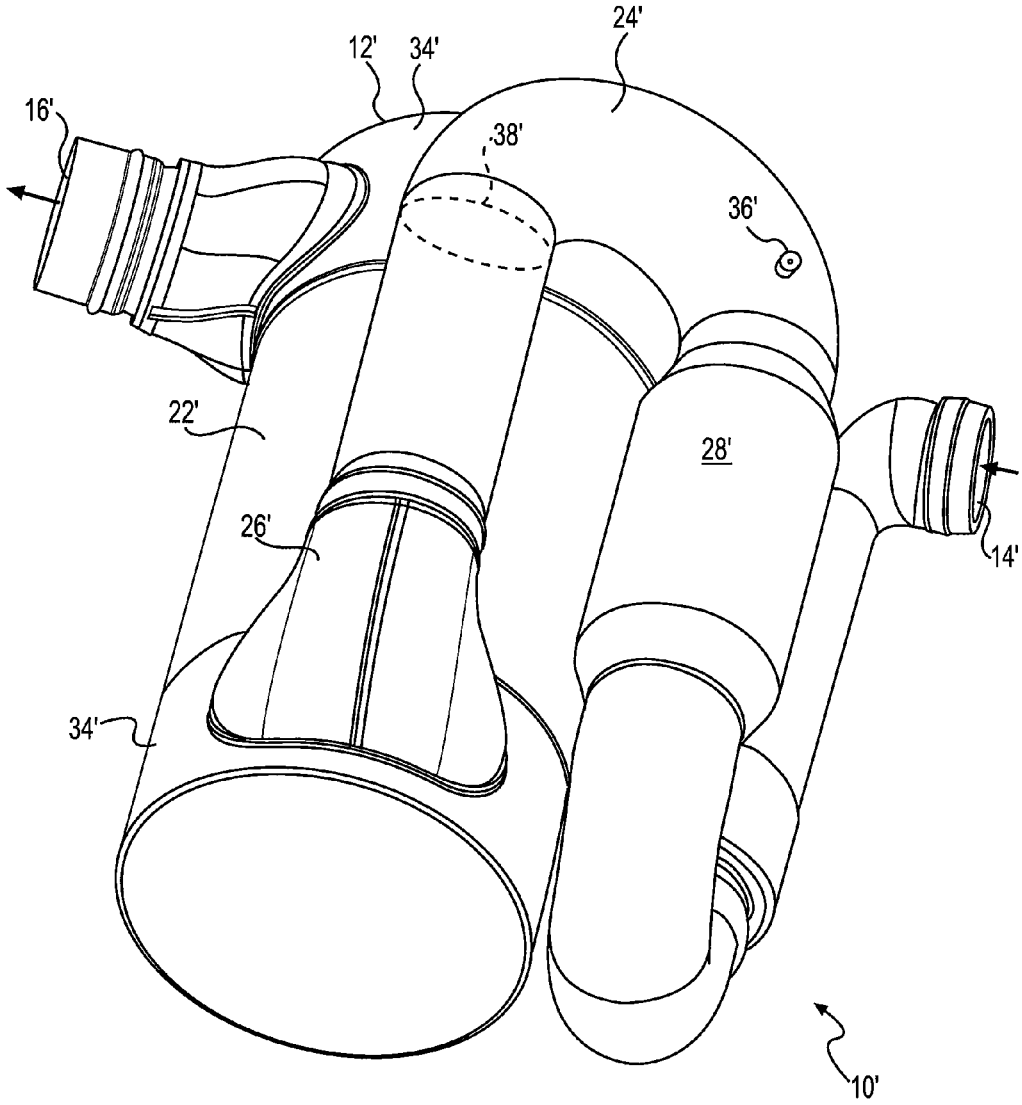
FIG. 4 is a perspective-view illustration of another aftertreatment module.

FIG. 4 illustrates an alternative embodiment of aftertreatment module 10'. Similar to the embodiment of FIGS. 1-3, aftertreatment module 10' of FIG. 4 may include canister 12' having inlet 14' and outlet 16' and enclosing opposing end spaces 34' and second portion 22'. In contrast to the embodiment of FIGS. 1-3, however, aftertreatment module 10' of FIG. 4 may not include first portion 20. That is, oxidation catalyst 28' and reductant injector 36', in the embodiment of FIG. 4, may be disposed within tube 24' rather than within canister 12'. In addition, tube 24' may have a general serpentine shape and change flow direction multiple times. In this configuration, tube 24' may have a flow length about three times the flow length of canister 12', yet still be contained within the axial length of canister 12' (i.e., tube 24' may not extend axially past ends of canister 12').

INDUSTRIAL APPLICABILITY

The aftertreatment modules of the present disclosure may be applicable to the exhaust system of any engine configuration requiring constituent conditioning, where component packaging is an important issue. The disclosed aftertreatment modules may improve packaging by utilizing a single canister to house treatment devices, and yet still provide sufficient reductant mixing and decomposition through the use of an external tube. Exhaust flow through aftertreatment module will now be described.

Referring to FIG. 1, an exhaust flow containing a complex mixture of air pollutants including, among other things, the oxides of nitrogen ($NO_X$), may be directed from an engine (not shown) into aftertreatment module 10 via inlet 14. The exhaust may flow from inlet 14 into aftertreatment module 10 and against wall 18, where the exhaust flow may be diverted by the inclination of wall 18 through oxidation catalyst 28. The angle of wall 18 and the corresponding gradual restriction provided to the incoming exhaust flow may facilitate substantially equal distribution of the exhaust across a face of oxidation catalyst 28. As the exhaust passes through oxidation catalysts 28, some of the NO within the exhaust may be converted to $NO_2$.

After passing through oxidation catalysts 28, the exhaust may flow into space 34 in first portion 20 of canister 12, through tube 24, and into space 34 in second portion 22 of canister 12. At this time, reductant may be injected into the exhaust flow upstream of mixer 38, such that the swirl and/or turbulence of the exhaust promoted by mixer 38 may be utilized to entrain and distribute reductant within the exhaust flow. As the swirling and/or turbulent flow of exhaust and reductant passes along the length of tube 24, the mixture may continue to homogenize and the reductant may begin to decompose. By the time the mixture reaches CDS catalyst 30, the bulk of the reductant should be decomposed for NOx reduction purposes within CDS catalyst 30 and catalyst 32.

As the exhaust passes through CDS catalyst 30, particulate matter may be removed from the exhaust and NOx may react with the reductant to be reduced to water and diatomic nitrogen. The exhaust may then exit CDS catalyst 30 and enter catalyst 32, where additional reduction of NOx may occur and residual reductant may be absorbed. After treatment within catalyst 32, the exhaust may be redirected by wall 18 for discharge to the atmosphere (or other downstream exhaust system components) via outlet 16.

Referring to FIG. 4, an exhaust flow containing a complex mixture of air pollutants including, among other things, the oxides of nitrogen (NOX), may be directed from an engine (not shown) into aftertreatment module 10' via inlet 14' of tube 24' and through oxidation catalyst 28'. As the exhaust passes through oxidation catalysts 28', some of the NO within the exhaust may be converted to NO2. At this time, reductant may be injected into the exhaust flow upstream of mixer 38', such that the swirl and/or turbulence of the exhaust promoted by mixer 38' may be utilized to entrain and distribute reductant within the exhaust flow. As the swirling and/or turbulent flow of exhaust and reductant passes along the length of tube 24', the mixture may continue to homogenize and the reductant may begin to decompose. By the time the mixture reaches CDS catalyst 30' within second portion 22', the bulk of the reductant should be decomposed for NOx reduction purposes within CDS catalyst 30' and catalyst 32'.

As the exhaust passes through CDS catalyst 30', particulate matter may be removed from the exhaust and NOx may react with the reductant to be reduced to water and diatomic nitrogen. The exhaust may then exit CDS catalyst 30' and enter catalyst 32', where additional reduction of NOx may occur and residual reductant may be absorbed. After treatment within catalyst 32', the exhaust may be redirected for discharge to the atmosphere (or other downstream exhaust system components) via outlet 16'.

Aftertreatment modules 10 and 10' may promote even exhaust distribution and sufficient reductant decomposition. In particular, the locations of inlets 14, 14' and outlets 16, 16', in combination with the inclination of wall 18 may promote even distribution across the treatment devices within canisters 12 and 12', while the length and location of tubes 24, 24' together with mixers 38, 38' may promote reductant decomposition. Spaces 34, 34', together with the configuration and location of couplings 26, 26', may also promote distribution and reductant decomposition.

Aftertreatment modules 10 and 10' may be simple, compact, and relatively inexpensive. Aftertreatment modules 10, 10' may be simple and compact because they may utilize only a single canister and catalysts that provide multiple functions. For example, CDS catalysts 30, 30' may provide both particulate trapping and NOx reduction functionality, while catalysts 32, 32' may provide both NOx reduction and reductant absorbing functionality. The simplicity of aftertreatment modules 10 and 10' may result in a lower cost solution to exhaust aftertreatment.

It will be apparent to those skilled in the art that various modifications and variations can be made to the aftertreatment module of the present disclosure without departing from the scope of the disclosure. Other embodiments will be apparent to those skilled in the art from consideration of the specification and practice of the aftertreatment module disclosed herein. It is intended that the specification and examples be considered as exemplary only, with a true scope of the disclosure being indicated by the following claims and their equivalent.

What is claimed is:

1. An aftertreatment module, comprising:

a canister defining an interior;

a first treatment device located in the interior of the canister at a first end portion of the canister;

a second treatment device located in the interior of the canister at an opposing second end portion of the canister;

a wall disposed in the interior of the canister to divide the interior into the first and second end portions;

an inlet physically-located between the first and second treatment devices and upstream of both the first and second treatment devices such that gas flowing into the inlet and through the aftertreatment module contacts a first side of the wall;

an outlet physically-located between the first and second treatment devices and downstream of both the first and second treatment devices such that the gas flowing through the aftertreatment module and out the outlet contacts a second side of the wall, the wall being located between the inlet and the outlet; and a tube external to the canister and defining a sole flow path for the gas between the first and second end portions of the canister.

2. The aftertreatment module of claim 1, wherein the tube connects the first end portion of the canister with the second end portion of the canister.

3. The aftertreatment module of claim 1, wherein the first treatment device is an oxidation catalyst, and the second treatment device is a combined particulate filter and SCR catalyst.

4. The aftertreatment module of claim 3, further including a cleanup catalyst located downstream of the second treatment device.

5. The aftertreatment module of claim 4, further including an additional SCR catalyst located downstream of the second treatment device and integral with the cleanup catalyst.

6. The aftertreatment module of claim 1, further including a reductant injector located upstream of the second treatment device.

7. The aftertreatment module of claim 1, further including at least one of:

a temperature probe located outward from the second treatment device relative to the inlet and the outlet; and a constituent sensor located between the first and second treatment devices and downstream of both the first and second treatment devices.

8. The aftertreatment module of claim 1, further including a mixer located downstream of the first treatment device and upstream of the second treatment device.

9. The aftertreatment module of claim 8, wherein the mixer is disposed in the tube.

10. The aftertreatment module of claim 1, wherein the wall is inclined relative to a longitudinal axis of the canister such that a flow area at the inlet becomes smaller a distance away from the inlet, and a flow area at the outlet becomes smaller a distance away from the outlet.

11. An aftertreatment module, comprising:

a canister defining an interior;

a first treatment device located in the interior of the canister at a first end portion of the canister;

a second treatment device located in the interior of the canister at an opposing second end portion of the canister;

a wall disposed in the interior of the canister to divide the interior into the first and second end portions;

an inlet physically-located between the first and second treatment devices and upstream of both the first and second treatment devices such that gas flowing into the inlet and through the aftertreatment module contacts a first side of the wall before flowing through the first treatment device;

an outlet physically-located between the first and second treatment devices and downstream of both the first and second treatment devices such that the gas flowing through the aftertreatment module and out the outlet contacts a second side of the wall after flowing through the second treatment device, the wall being located between the inlet and the outlet;

a tube external to the canister and defining a sole flow path for the gas between the first and second end portions of the canister; and a reductant injector disposed upstream of the tube, the reductant injector configured to inject reductant into the gas after the gas flows through the first treatment device and before the gas flows through the second treatment device.

12. The aftertreatment module of claim 11, wherein the tube connects the first end portion of the canister with the second end portion of the canister.

13. The aftertreatment module of claim 11, wherein the first treatment device is an oxidation catalyst, and the second treatment device is a combined particulate filter and SCR catalyst.

14. The aftertreatment module of claim 13, further including a cleanup catalyst located downstream of the second treatment device.

15. The aftertreatment module of claim 14, further including an additional SCR catalyst located downstream of the second treatment device and integral with the cleanup catalyst.

16. The aftertreatment module of claim 11, wherein the reductant injector is located upstream of the second treatment device.

17. The aftertreatment module of claim 11, further including at least one of:

a temperature probe located outward from the second treatment device relative to the inlet and the outlet; and a constituent sensor located between the first and second treatment devices and downstream of both the first and second treatment devices.

18. The aftertreatment module of claim 11, further including a mixer located downstream of the first treatment device and upstream of the second treatment device.

19. The aftertreatment module of claim 18, wherein the mixer is disposed in the tube.

20. The aftertreatment module of claim 11, wherein the wall is inclined relative to a longitudinal axis of the canister such that a flow area at the inlet becomes smaller a distance away from the inlet, and a flow area at the outlet becomes smaller a distance away from the outlet.

* * * * *